United States Patent [19]

Ozasa et al.

[11] 4,175,814

[45] Nov. 27, 1979

[54] CRUSHER FOR SOLID MATERIALS TRANSPORTED BY PRESSURIZED LIQUID

[75] Inventors: Masahiro Ozasa, Tokorozawa; Kenya Murayama, Kawagoe; Masako Okumura, Osaka, all of Japan

[73] Assignees: Ohbayashi-Gumi Co., Ltd.; KYC Machine Industry Co., both of Japan

[21] Appl. No.: 892,674

[22] Filed: Apr. 3, 1978

[51] Int. Cl.[2] ..... B02C 23/36

[52] U.S. Cl. ..... 241/46 R; 241/21; 241/259

[58] Field of Search ..... 241/20, 21, 254, 228, 241/229, 81, 15, 16, 46 R; 302/14–16

[56] References Cited

U.S. PATENT DOCUMENTS

| | | | |
|---|---|---|---|
| 2,466,443 | 4/1949 | Klassen | 241/254 X |
| 2,804,272 | 8/1957 | Montgomery | 241/81 X |
| 3,241,775 | 3/1966 | Ciendaniel et al. | 241/21 |
| 3,909,960 | 10/1975 | Casciano | 302/15 X |

*Primary Examiner*—E. F. Desmond

*Attorney, Agent, or Firm*—Emrich, Root, O'Keeffe & Lee

[57] ABSTRACT

Solid materials are fed into a crusher together with a pressurized liquid and led to a crushing passage for crushing large solid blocks therein into smaller solid particles. The crushed solid particles are discharged into a transportation pipe together with the pressurized liquid for piping out.

The crusher comprises a laterally extending cylindrical housing provided with an inflow port and an outflow port, and a cylindrical rotor eccentrically provided at the inside of the cylindrical housing to define the crushing passage therebetween, which passage becomes narrower toward the outflow port.

4 Claims, 6 Drawing Figures

CRUSHER FOR SOLID MATERIALS TRANSPORTED BY PRESSURIZED LIQUID

BACKGROUND OF THE INVENTION

This invention relates to a method for transporting solid blocks by crushing into smaller solid particles and a crusher adapted therefore.

It is known to transport solid materials by means of a pressurized liquid, such as water or slurry, through a pipe. Such a method is widely used in a slurry shield method for constructing a tunnel by excavating the earth. In the slurry shield method, a steel tubular frame is used to sustain the earth pressure while the nose of the tube is equipped to excavate the earth, wherein a slurry is circulated under pressure for the stabilization of the area to be cut by an excavator and simultaneously for enabling transport of muck or excavated solid materials as a fluid mixture. In order to enable the effective circulation of the slurry, it has been required to separate or remove large solid blocks in the muck mixed in the slurry being piped out. Because, the large solid blocks in the excavated muck will clog the transportation pipe, whereby the circulation of the slurry becomes impossible. On the other hand, if a transportation pipe having a larger diameter is used to enable the transportation of the large solid blocks, a pressurizing pump for the transportation pipe will become bigger and facilities for transportation of the solid blocks will become huge.

Accordingly, it has been a normal procedure to once classify and remove the large solid blocks from the transportation line and to continuously transport only the classified small solid particles through a transportation pipe together with the liquid. The removed large solid blocks are crushed into smaller solid particles in the air, which are again introduced into the transportation line or pipe for piping out.

However, in such a known method which requires to crush the large solid blocks into smaller particle size in the air, there caused some problems such as spattering of the dust, noise of crushing and the like. Further, it has been troublesome to remove the large solid blocks from the transportation line for crushing into smaller particles and to introduce them again into the transportation line. In addition, in order to classify and remove the large solid blocks contained in the liquid and to continuously transport only the separated small solid particles, it has been required to use additional equipments such as rotary classifier.

BRIEF SUMMARY OF THE INVENTION

Accordingly, an object of the present invention is to provide a method for continuously transporting large solid blocks by crushing into small solid particles while being carried by a pressurized liquid.

Another object of the present invention is to provide a crusher suited for crushing large solid blocks in a liquid into small solid particles.

Still another object of the present invention is to provide a crusher which effectively crushes large solid blocks into small solid particles and allows the crushed small solid particles to be smoothly discharged therefrom together with the liquid.

A further object of the present invention is to provide a crusher which is relatively compact and suited for use with a slurry shield method.

Another object of the present invention is to provide a crusher whcih allows some of small solid particles to be diverted from the crushing passage.

The present method for transporting solid materials by a pressurized liquid comprises feeding the solid materials into a crusher together with the pressurized liquid flowing at a velocity high enough not to cause sedimentation of large solid blocks therein, leading the large solid blocks to a crushing passage for crushing into smaller solid particles while the solid blocks are carried by the pressurized liquid, and discharging the crushed solid particles into a transportation pipe together with the pressurized liquid, the liquid in the transportation pipe flowing at a velocity high enough not to cause sedimentation of the crushed solid particles in the pipe.

Preferably, some of the solid materials having small particle size are diverted from the crushing passage and confluent with the crushed solid particles for further transporting in the transportation pipe.

The present crusher for crushing large solid blocks carried by a pressurized liquid comprises a laterally extending cylindrical housing having an inflow port and an outflow port, the inflow port being provided at the upper portion of the housing through which the large solid blocks are fed together with the pressurized liquid, the outflow port being provided at the lower portion of the housing through which crushed solid particles are discharged into a transportation pipe, and a cylindrical rotor eccentrically rotatable at the inside of the cylindrical housing, the cylindrical rotor and housing defining a crushing passage therebetween, the crushing passage becoming narrower toward the outflow port.

Preferably, the inflow port is tangentially inclined relative to the cylindrical side wall of the housing and directed to the upper part of the crushing passage.

More preferably, the cylindrical housing is provided with a plurality of guide plates at the inner circumferential portion thereof opposite to the crushing passage. The guide plates have upper ends inclined toward the upper part of the crushing passage for leading the large solid blocks to the crushing passage. The guide plates are spaced from each other to allow small solid particles to fall down through the spaces therebetween toward the outflow port.

Other objects and features of the present invention will become apparent from the detailed description of preferred embodiments thereof when taken in conjunction with the accompanying drawings, in which:

DETAILED DESCRIPTION OF THE INVENTION

Figure 1:
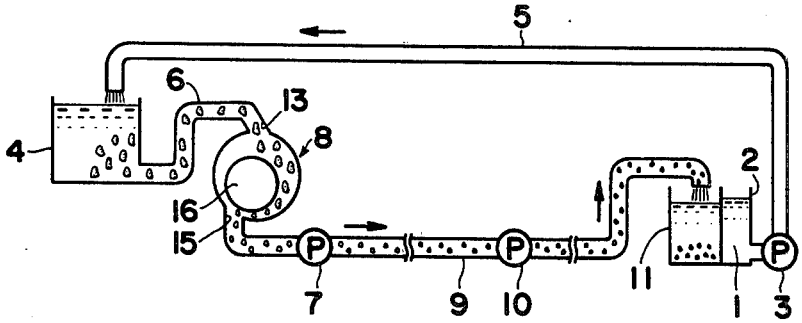
FIG. 1 is a schematic view showing a transportation method according to an embodiment of the present invention.
Figure 2:
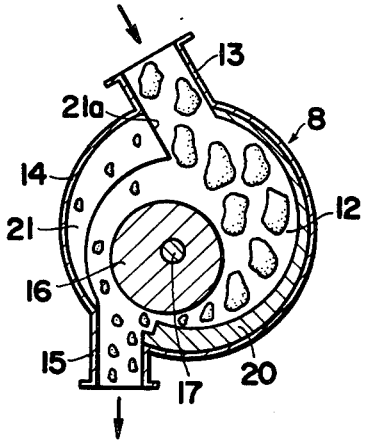
FIG. 2 is a vertically sectioned front view showing a crusher adapted to the method in FIG. 1.
Figure 3:
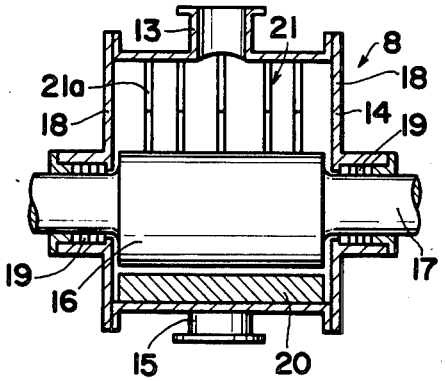
FIG. 3 is a vertically sectioned side view of the crusher in FIG. 2.

Referring to a first embodiment of the present invention shown in FIGS. 1 through 3, water 1 in a storage tank 2 is pressurized by a first pump 3 and fed back to a chamber 4 through a pipe 5. The chamber 4 contains solid materials of various particle sizes including large solid blocks and small solid particles. The mixture of the solid materials and the water both contained in the chamber 4 is then transported through a main pipe 6 by a pressure generated by a second pump 7. The second pump 7 is selected from such one as having high capacity to enable the large solid blocks in the chamber 4 to be transported by the pressurized water. The main pipe 6 is connected to an upper opening of the crusher 8, so that all of the mixture of the solid materials and the water in the main pipe 6 are fed into the crusher 8. While the mixture fed into the crusher 8 moves down to the outflow port thereof, the large solid blocks are crushed into small solid particles, as referred hereinafter in detail. The crushed small solid particles as well as the other small ones not subjected to crushing are discharged from the outflow port of the crusher and then piped out through a transportation pipe 9 by the action of the second pump 7 and a third pump 10 into a solid storage tank 11, from which the water 1 is separated into the water storage tank 2 for recirculation.

Referring now to a crusher 8 of the present invention adapted to the transportation method set forth above, it comprises a cylindrical housing 12 the axis of which extends in the horizontal direction. The housing 12 has an inflow port 13 at the upper end thereof which is inclined almost in the tangential direction of the cylindrical side wall 14 and an outflow port 15 at the lower end portion thereof. Eccentrically provided inside of the cylindrical housing 12 is a cylindrical rotor 16 to which a rotary shaft 17 is also eccentrically secured. The rotary shaft 17 extends through both side walls 18—18 of the cylindrical housing 12 with bearings 19—19 being interposed therebetween. This rotary shaft 17 is operably connected to an appropriate driving means (not shown).

Also provided at the inner circumferential parts of the cylindrical housing 12 are a lining 20, which is substantially crescent-shaped in section and extends along the cylindrical side wall 14 in the lengthwise direction thereof, and a plurality of guide plates 21, which are also substantially crescent-shaped in section and spaced from each other at appropriate intervals in the lengthwise direction of the cylindrical side wall 14. The lining 20 and the guide plates 21 are opposite with each other about the center axis of the cylindrical housing 12. The lining 20 and the rotor 16 define a crushing passage therebetween, to the upper portion of which the inclined inflow port 13 is directed. The lining 20 as well as the rotor are made of such materials as having high coefficient of friction and also high durability against abrasion. The lining 20 is provided in such a manner that when the eccentric rotor 16 rotates in the clockwise direction as shown by an arrow in FIG. 2, the spaces, i.e. crushing passage, between the outer circumference of the rotor and the inner surface of the lining 20 are gradually reduced toward the lower end of the lining 20 which is adjacent to the outflow port 15 of the cylindrical housing 12. The guide plates 21 each has an upper end **21*a* which is inclined inwardly toward the upper portion of the crushing passage so as to form an inclined straight line with the inner lower surface of the inflow port 13**.

In such a structure of the crusher 8, when the mixture of the solid materials and liquid is fed into the inflow port 13 of the cylindrical housing 12, the solid blocks larger than the interval between the adjacent guide plates 21 are guided by the upper ends **21*a* of the guide plates 21 toward the space between the upper end of the lining 20 and the eccentric rotor 16, while the small solid particles less than the interval between the adjacent guide plates 21 are allowed to be diverted from the moving direction of the large solid blocks and to fall down through spaces between the adjacent guide plates 21 toward the outflow port 15. The large solid blocks coming into the space, i.e. crushing passage, between the lining 20 and the eccentric rotor 16 are then subjected to crushing while the eccentric rotor 16 rotates about the shaft 17 due to the reducing spaces therebetween. The crushed smaller solid particles are then discharged from the outflow port 15 into the transportation pipe 9 and carried by the liquid for piping out. The small solid particles fallen down through the spaces between the adjacent guide plates 21 are directly discharged from the outflow port 15 and then confluent with the crushed small solid particles for further transportation in the transportation pipe by the liquid also discharged from the outflow port 15**.

As it could be understood from the disclosure set forth above, since the solid blocks are crushed in the liquid, the present invention is free from the conventional problems such that the solid blocks are forced to impinge against the crushing device in the air to generate noise and to cause jumping of the solid blocks. Thus, in comparison with the known dry-type crushing device, the present crusher improves the crushing efficiency, prevents spattering of the dust and generates no noise at the time of crushing.

Further, due to such a structure of the present crusher that some of the small solid particles fall down through the spaces between the guide plates 21 toward the outflow port 15 without passing through the crushing passage between the lining 20 and the rotor 16, the possibility that the crushing passage is choked or clogged by the small solid particles is much reduced. The crushing passage between the lining 20 and the eccentric rotor 16 has a wide space at the upper end of the lining 20 but becomes narrower as it goes toward the outflow port 15. This wide space at the upper end of the lining 20 allows the large solid blocks to be entered into the crushing passage. Since the large solid blocks are fed into the crushing passage together with the pressurized liquid, these solid blocks are urged into the narrower part of the crushing passage by the liquid and the crushed solid particles are smoothly discharged from the outflow port 15 of the cylindrical housing 12. The inflow port 13 inclined tangentially to the cylindrical side wall 14 facilitates the smooth flowing of the liquid mixture along the inner surfaces of the cylindrical side wall and the lining 20. Also, the inclined inflow port 13 as well as the upper ends **21*a* of the guide plates 21** effectively lead the large solid blocks into the crushing passage.

Further advantages of the present crusher can be obtained when it is used in connection with a slurry shield method for constructing a tunnel by excavating the earth. Usually, the tunnel thus formed by the slurry shield method has not so large space especially in the vertical direction. Accordingly, it is desired that all of the equipments for piping out the excavated dross or solid materials be compact. The crusher of the present invention is very compact due to the laterally extending cylindrical housing, so that it can be installed in a tunnel space having not so high space.

Moreover, in the crusher of the present invention, the internal volume of the cylindrical housing 12 is constant at any rotary position of the rotor 16, so that the flow of mixture of the liquid and the solid particles discharged from the outflow port 15 is constant and does not pulsate.

The solid particles discharged from the outflow port 15 of the crusher have small particle sizes less than a predetermined size, so that these solid particles can be transported by a reduced pressure. Thus, it becomes possible to reduce the diameter of the transportation pipe 9 and to transport the solid materials for a long distance by the pump 10. In addition, the durability of the transportation pipe 9 is much improved. In consequence, the total costs for transporting the solid materials can be much reduced.

Figure 4:
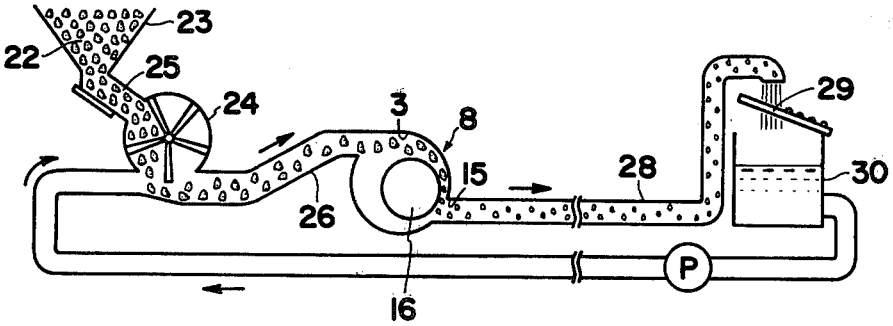
FIG. 4 is a schematic view showing another transportation method according to a second embodiment of the present invention.

Referring to a second embodiment of the present method shown in FIG. 4, this method is adapted for transporting solid materials or muck excavated in the construction of a tunnel by open-cut. The excavated solid materials 22 are collected in a hopper 23 and fed into a rotary valve 24 through a feeder 25. The excavated solid materials have various sizes from small solid particles to large solid blocks. In the rotary valve, a predetermined amount of solid particles is successively fed into the main pipe 26 through which a pressurized slurry is circulated by a pump 27. The flow velocity of the slurry in the main pipe 26 is high enough to transport the large solid blocks fed therein from the rotary valve 24. Then, the solid materials are fed into the crusher 8 of the type set forth above, wherein the large solid blocks are crushed into small solid particles by the rotation of the rotor 16 and discharged from the outflow port 15 thereof into a transportation pipe 28. Since the crushed solid particles have small particle size, it is possible to transport such crushed solid particles for a long distance through the transportation pipe 28 by the action of the pump 27. The solid particles piped out from the transportation pipe 28 are removed by a screen 29, while the liquid piped out from the transportation pipe 28 is stored in a tank 30 for recirculation by the pump 27.

Figure 5:
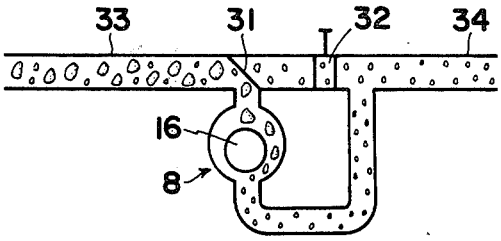
FIG. 5 is a schematic view showing a transportation method according to a third embodiment of the present invention.

In the both embodiments set forth above, all of the solid materials in the main pipe are made to pass through the present crusher 8. However, some of the solid particles in the main pipe, which are small enough to be carried through the transportation pipe by the pressurized liquid flowing therethrough, need not be passed through the crusher 8. Accordingly, it is preferable to provide a classifier 31 and a flow amount regulating valve 32 in parallel to the crusher 8 as shown in FIG. 5. In this preferred embodiment, the solid materials carried by the pressurized liquid in the main pipe 33 collide against the classifier 31 having small openings. The small solid particles less than the opening in the classifier 31 are allowed to pass therethrough into the transportation pipe 34, while the large solid blocks larger than the opening in the classifier 31 are by-passed to the crusher 8 where the solid blocks are crushed into smaller solid particles and carried to the transportation pipe 34 for discharge. By adjusting the flow amount regulating valve 32, the amount of small solid particles which can pass through the openings in the classifier 31 can be controlled.

Figure 6:
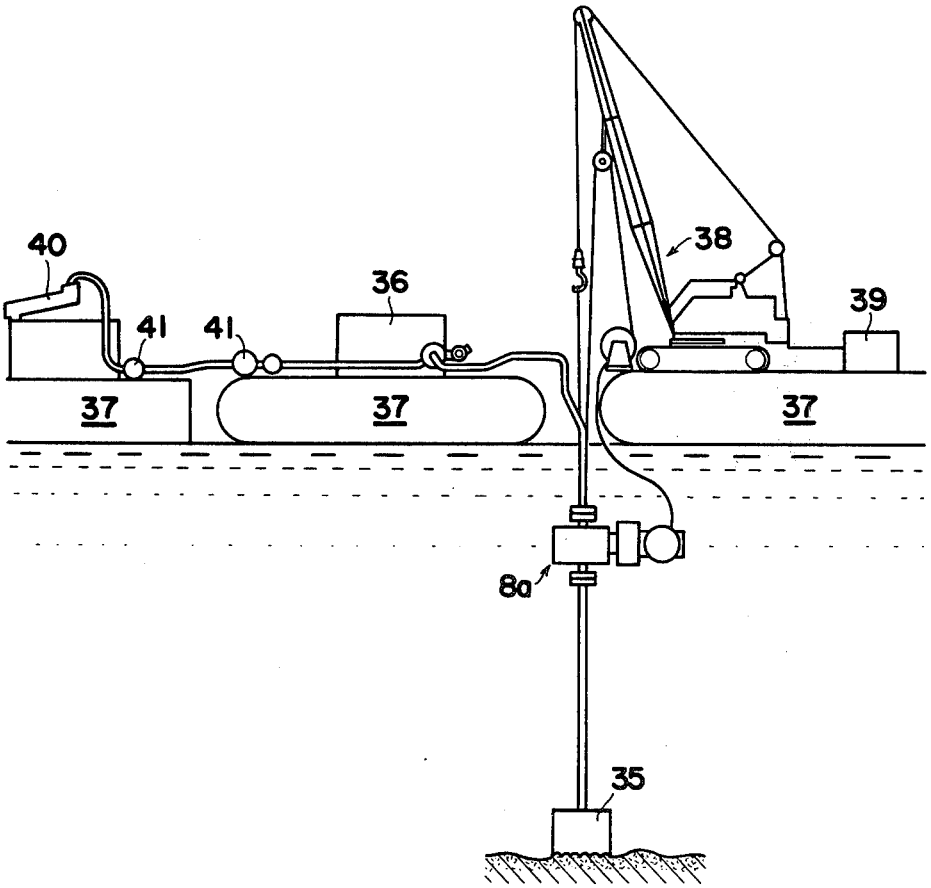
FIG. 6 is also a schematic view showing a transportation method according to a fourth embodiment of the present invention.

Although the present method can be conveniently adapted to a transportation of the excavated dross or solid materials in the construction of a tunnel or the like on the ground, it can be adapted to many other transportation methods of the solid materials due to compact structure of the crusher. FIG. 6 shows another embodiment of the present method adapted to the reverse system underwater excavation. In this embodiment, rocks, sand and gravels at the bottom of water are excavated by a drill or excavator 35 and sucked up into the present crusher **8*a* together with the water by a vacuum means 36 on a foundation barge 37. The crusher 8*a* under the water is supported by a crawler crane 38 on the barge 37 and actuated by a power source 39 also provided on the barge 37. The solid materials sucked up into the crusher 8*a* are crushed into small solid particles and then transported together with the water to a classifier or separator 40 by a booster pump 41**. In this manner, it is possible to adapt the present method for the underwater excavation so as to transport the solid blocks at the bottom as a slurry.

Many other modifications and alterations may be made within the spirit of the present invention.

We claim:

1. A crusher for crushing relatively large solid blocks carried by a pressurized liquid comprising:

a laterally extending stationary cylindrical housing having an inflow port and an outflow port, said inflow port being provided at the upper portion of said housing through which the relatively large solid blocks are fed with the pressurized fluid, said outflow port being provided at the lower portion of said housing through which the crushed solid particles are discharged into a transportation pipe, and a cylindrical rotor eccentrically rotatable inside said cylindrical housing, said cylindrical rotor and housing defining a crushing passage therebetween, said crushing passage becoming narrower toward said outflow port, said inflow port being tangentially inclined relative to the cylindrical side wall of said housing and directed to the upper part of said crushing passage whereby the relatively large solid blocks and the pressurized liquid will be fed together into said crushing passage in the direction in which said cylindrical rotor rotates.

2. A crusher as claimed in claim 1, wherein said rotor is provided to be eccentric to said cylindrical housing, and the rotary axis of said rotor is eccentric to the center thereof.

3. A crusher for crushing large solid blocks carried by a pressurized liquid comprising:

a laterally extending cylindrical housing having an inflow port and an outflow port, said inflow port being provided at the upper portion of said housing through which the large solid blocks are fed together with the pressurized liquid, said outflow port being provided at the lower portion of said housing through which crushed solid particles are discharged into a transportation pipe, a cylindrical rotor eccentrically rotatable at the inside of said cylindrical housing, said cylindrical rotor and housing defining a crushing passage therebetween, said crushing passage becoming narrower toward said outflow port, and a plurality of guide plates within said cylindrical housing at the inner circumferential portion thereof opposite to said crushing passage, said guide plates having upper ends inclined toward the upper part of said crushing passage for leading said large solid blocks to said crushing passage, and being spaced from each other to allow small solid particles to fall down through the spaces therebetween toward said outflow port.

4. A crusher for crushing large solid blocks carried by a pressurized liquid comprising:

a laterally extending cylindrical housing having an inflow port and an outflow port, said inflow port being provided at the upper portion of said housing through which the large solid blocks are fed together with the pressurized liquid, said outflow port being provided at the lower portion of said housing through which crushed solid particles are discharged into a transportation pipe, a cylindrical rotor eccentrically rotatable at the inside of said cylindrical housing, said cylindrical rotor and housing defining a crushing passage therebetween, said crushing passage becoming narrower toward said outflow port, and a crescent-shaped lining at the inner circumferential portion of said cylindrical housing, said lining and said rotor defining said crushing passage therebetween.

* * * * *